US005758386A

United States Patent [19]

Chen

[11] Patent Number: 5,758,386

[45] Date of Patent: Jun. 2, 1998

[54] BATH SCRUBBER

[76] Inventor: Ching-Chen Chen, No. 1, Lane 147, Sec. 2, Chung San Rd., Yun Lin, Chang Hua Hsien, Taiwan

[21] Appl. No.: 714,258

[22] Filed: Sep. 17, 1996

[51] Int. Cl.[6] ..... A47L 13/10

[52] U.S. Cl. ..... 15/229.11; 15/209.1; 15/229.13

[58] Field of Search ..... 15/209.1, 222–224, 15/229.11, 229.12, 229.13

[56] References Cited

U.S. PATENT DOCUMENTS

| | | | |
|---|---|---|---|
| 1,851,237 | 3/1932 | Bradford | 15/229.11 |
| 1,865,785 | 7/1932 | Parker | 15/209.1 |
| 2,581,779 | 1/1952 | Abraham | 15/229.11 |
| 4,206,948 | 6/1980 | Shimizu | 15/223 |

FOREIGN PATENT DOCUMENTS

| | | | |
|---|---|---|---|
| 482997 | 8/1954 | Italy | 15/229.11 |

*Primary Examiner*—Terrence Till
*Attorney, Agent, or Firm*—Bacon & Thomas

[57] ABSTRACT

A bath scrubber comprises an elastic webbed tube, two first lashing members and one second lashing member. The webbed tube has a periphery which is pleated continuously in the direction of the longitudinal axis of the webbed tube. The first lashing members are secured respectively to both ends of a first radial direction of the webbed tube. The second lashing member is secured to the periphery of the webbed tube such that the second lashing member is perpendicular to the first radial direction of the webbed tube so as to enable the webbed tube to form two expanded integral parts of different sizes.

2 Claims, 3 Drawing Sheets

FIG. 5a
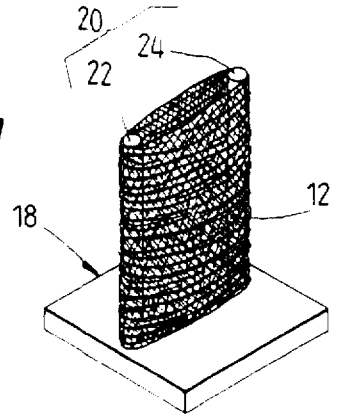
FIG. 5b
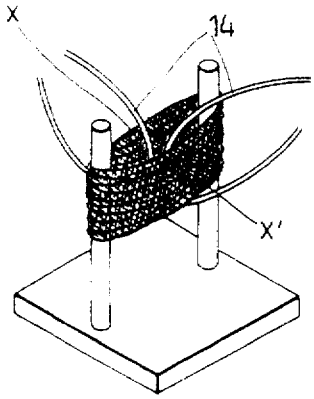
FIG. 5c
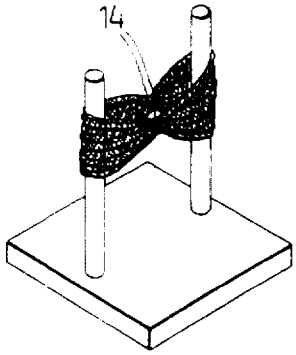
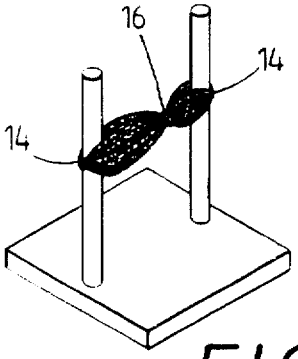
FIG. 5e
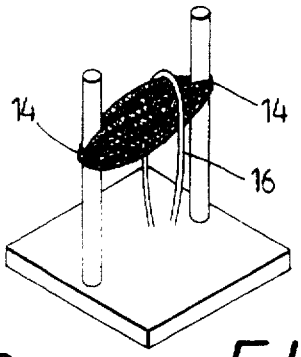
FIG. 5d

BATH SCRUBBER

FIELD OF THE INVENTION

The present invention relates generally to a bath apparatus, and more particularly to a bath scrubber made of an elastic webbed material.

BACKGROUND OF THE INVENTION

As shown in FIG. 1, a prior art bath scrubber 1 is lashed at the midsegment thereof with a lashing member so as to cause the bath scrubber to have a spherical shape. Such a prior art bath scrubber as described above is defective in design in that it is devoid of a gripping apparatus to facilitate the holding of the bath scrubber by its user.

With a view to improving the prior art bath scrubber referred to above, the bath scrubber 1 is provided with a grip 2 fastened therewith, as shown in FIG. 2. The grip 2 is made of a rigid material and is therefore bound to cause skin discomfort to the user.

SUMMARY OF THE INVENTION

The primary objective of the present invention is therefore to provide a bath scrubber comprising two integral parts, one of which is intended for scrubbing and other one of which is intended for use as a grip.

In keeping with the principle of the present invention, the foregoing objective of the present invention is attained by an improved bath scrubber, which comprises an elastic webbed tube of a predetermined length. The elastic webbed tube is caused to take a cylindrical form with a wavy periphery by making the periphery of the webbed tube to fold continuously along the direction of the longitudinal axis of the webbed tube. The bath scrubber further comprises two first lashing members and a second lashing member for causing the webbed tube to form two integral parts intended respectively for scrubbing and gripping.

The foregoing objective, features, functions and advantages of the present invention will be more readily understood upon a thoughtful deliberation of the following detailed description of an embodiment of the present invention in conjunction with the accompanying drawings.

BRIEF DESCRIPTION OF THE DRAWINGS

FIGS. 5*a–e* are a schematic view illustrating the process flow of the embodiment of the present invention.

DETAILED DESCRIPTION OF THE INVENTION

Figure 1:
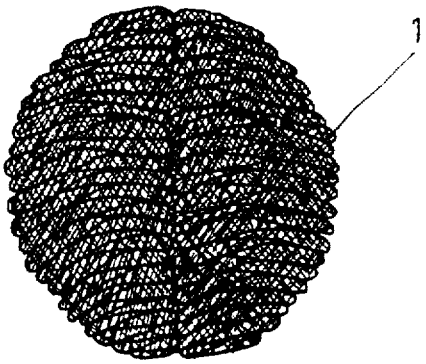
FIG. 1 PRIOR ART
FIG. 1 shows a perspective view of a bath scrubber of the prior art.
Figure 2:
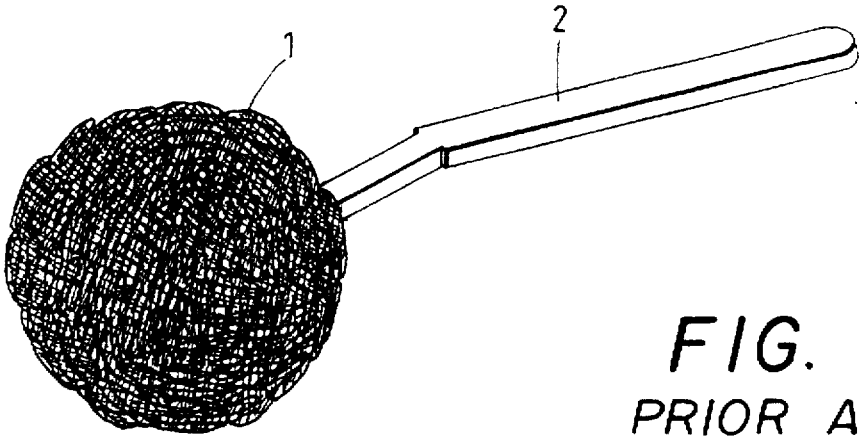
FIG. 2 PRIOR ART
FIG. 2 shows a perspective view of another bath scrubber of the prior art.
Figure 3:
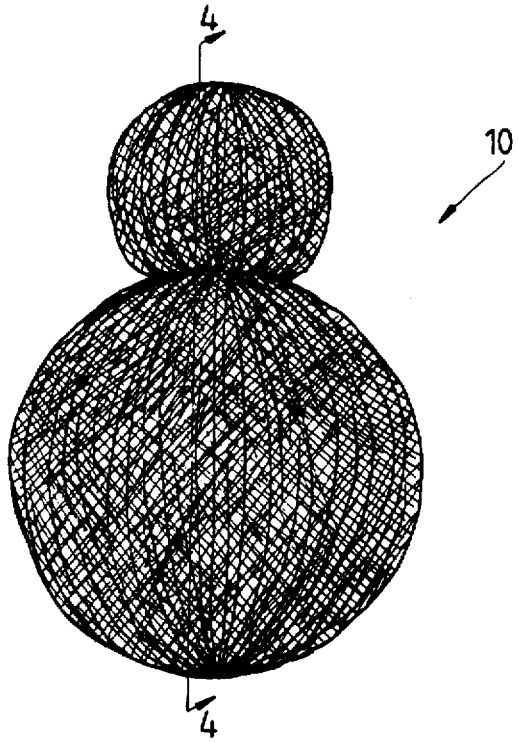
FIG. 3 shows a perspective view of the embodiment of the present invention.
Figure 4:
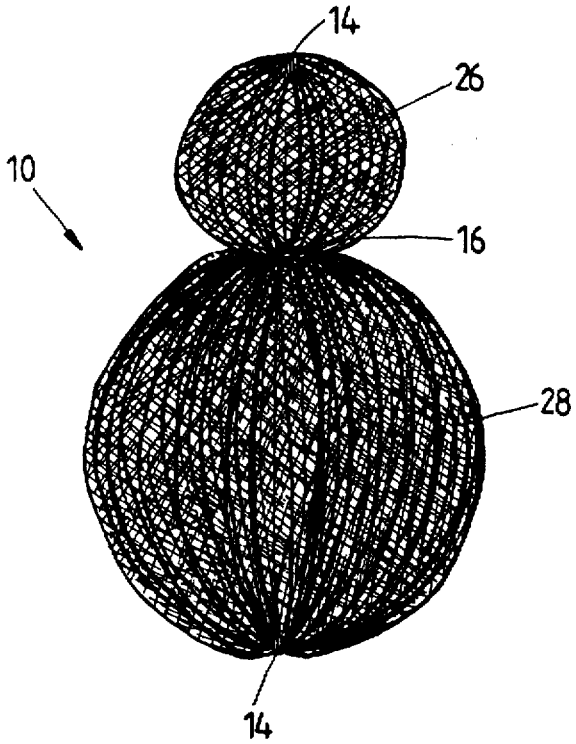
FIG. 4 shows a sectional view taken along the direction indicated by a line 4—4 as shown in FIG. 3.

As shown in FIGS. 3–5*e*, a bath scrubber 10 embodied in the present invention is composed of a webbed tube 12, two first lashing members 14, and a second lashing member 16.

The webbed tube 12 is made of a plastic material and has a predetermined length. The periphery of the webbed tube 12 is folded continuously in the direction of the longitudinal axis of the tube 12. For example, the webbed tube 12 is secured to a locating set 20 of the molding tool 18 such that the webbed tube 12 is first caused to expand by a first support rod 22 and a second support rod 24 of the locating set 20, and that the periphery of the webbed tube 12 is then extruded along the direction of the longitudinal axis of the tube 12 so as to make the periphery wavy.

The first lashing members 14 and the second lashing member 16 are threads of a cotton material and having a predetermined length; they are secured to the predetermined portions of the webbed tube 12.

These two first lashing members 14 are wound tightly on the inner and the outer edges of the tube wall of both ends along a first radial direction XX' such that the pleated periphery is confined securely. For example, the two first lashing members 14 are respectively wound on the inner and the outer edges of two corresponding sides of the periphery of the webbed tube 12 before these two first lashing members 14 are tightened up.

The second lashing member 16 is wound on the outer edge of the webbed tube 12 such that the second lashing member 16 is perpendicular to the first radial direction, and that the second lashing member 16 is close to the first lashing member 14 which is located on the right side. Thereafter, the second lashing member 16 is tightened up. For example, the webbed tube 12 is rotated for an angle so as to cause the first lashing members 14 to locate at the outsides of the first support rod 22 and the second support rod 24. Thereafter, the second lashing member 16 is wound on the webbed tube 12 such that the second lashing member 16 is near the right side of the webbed tube 12 and is then tightened up. Finally, the webbed tube 12 is removed from the locating set 20, thereby causing the untightened portions of the webbed tube 12 to expand outwards so as to form two integral parts, one of which is a gripping portion 26 and other one of which is a scrubbing portion 28. In other words, the bath scrubber 10 of the present invention is shaped like a calabash.

The bath scrubber 10 of the present invention is inherently superior in design to the prior art bath scrubber in that the gripping portion 26 and the scrubbing portion 28 of the bath scrubber 10 are secured by means of two first lashing members 14 and one second lashing member 16, so as to enhance the cleaning effect of the bath scrubber 10. In addition, the bath scrubber 10 of the present invention is shaped like a calabash to provide two integral parts of different sizes, thereby eliminating the rigid grip capable of causing skin discomfort to the user.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A bath scrubber comprising:

an elastic webbed tube of a predetermined length and having a periphery which is pleated continuously in the direction of a longitudinal axis of said webbed tube;

two first lashing members secured on the inner and outer edges of the tube wall and respectively to two ends of said webbed tube along a first radial direction; and a second lashing member secured to said periphery of said webbed tube such that said second lashing member is perpendicular to said first radial direction to enable said webbed tube to form two expanded integral parts.

2. The bath scrubber as defined in claim 1, wherein said second lashing member is located in such a manner that said second lashing member is offset from a center of said first radial direction so as to enable said webbed tube to form said two expanded integral parts of different sizes.

* * * * *